US012404736B2

(12) United States Patent
Katanguri et al.

(10) Patent No.: US 12,404,736 B2
(45) Date of Patent: Sep. 2, 2025

(54) ELECTRICALLY-ACTUATED BLOW-OUT PREVENTER

(71) Applicant: Schlumberger Technology Corporation, Sugar Land, TX (US)

(72) Inventors: Suman Katanguri, Sugar Land, TX (US); Matthew Givens, Houston, TX (US); Matthew Olson, Cypress, TX (US); Jesse Hardt, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/318,197

(22) Filed: May 16, 2023

(65) Prior Publication Data

US 2024/0384618 A1 Nov. 21, 2024

(51) Int. Cl.
*E21B 33/06* (2006.01)

(52) U.S. Cl.
CPC ..... *E21B 33/063* (2013.01); *E21B 33/062* (2013.01)

(58) Field of Classification Search
CPC ..... E21B 33/06; E21B 33/061; E21B 33/062; E21B 33/063; E21B 33/064
See application file for complete search history.

(56) References Cited

U.S. PATENT DOCUMENTS 11,513,024 B2 11/2022 Rogers et al.
11,555,372 B1 * 1/2023 Al-Mousa ..... E21B 33/0355
2014/0069351 A1 3/2014 Stratton
2014/0311735 A1 * 10/2014 Landrith, II ..... E21B 34/16 166/250.04
2015/0152705 A1 * 6/2015 Jaffrey ..... E21B 33/076 137/553
2015/0308212 A1 10/2015 Maunus
2016/0265300 A1 9/2016 Affleck
2018/0010411 A1 * 1/2018 Kroesen ..... E21B 33/063
2018/0347710 A1 * 12/2018 Whitby ..... E21B 33/062
2019/0003275 A1 * 1/2019 Deul ..... E21B 33/062
2019/0229591 A1 * 7/2019 Hjertvikrem ..... H02K 11/33
2019/0368299 A1 * 12/2019 Jorud ..... E21B 34/066
2020/0284274 A1 * 9/2020 van Kuilenburg .... E21B 33/062
2020/0370988 A1 * 11/2020 Rogers ..... F04B 15/02
2021/0277768 A1 * 9/2021 Wu ..... H02P 6/18
2021/0381332 A1 * 12/2021 Dhamodaran ..... E21B 33/062
(Continued)

FOREIGN PATENT DOCUMENTS

CN 107355193 A * 11/2017 ..... E21B 33/06
CN 207111033 U * 3/2018
(Continued)

OTHER PUBLICATIONS

CN 107355193.*
(Continued)

*Primary Examiner* — Daniel P Stephenson
(74) *Attorney, Agent, or Firm* — Jeffrey D. Frantz

(57) ABSTRACT

A method includes actuating a blow-out preventer (BOP) by moving a ram using an electric motor. The method also includes capturing sensor data with one or more sensors as the BOP is electrically-actuated. The method also includes determining one or more parameters with a controller based upon the sensor data. The method also includes controlling the electric motor based upon the one or more parameters.

5 Claims, 8 Drawing Sheets

(56) References Cited

U.S. PATENT DOCUMENTS

| | | | | |
|---|---|---|---|---|
| 2022/0136356 | A1* | 5/2022 | Poveda | E21B 34/16 166/373 |
| 2022/0145730 | A1 | 5/2022 | Benson | |
| 2023/0127022 | A1* | 4/2023 | Egbe | E21B 44/00 700/282 |
| 2024/0344443 | A1 | 10/2024 | Katanguri | |
| 2024/0344918 | A1 | 10/2024 | Katanguri | |

FOREIGN PATENT DOCUMENTS

| | | | | |
|---|---|---|---|---|
| CN | 116220605 | B * | 8/2023 | |
| EP | 3077612 | B1 | 5/2020 | |
| WO | 2014147406 | A2 | 9/2014 | |
| WO | 2019158723 | A1 | 8/2019 | |
| WO | WO-2020153961 | A1 * | 7/2020 | E21B 34/066 |
| WO | WO-2020169714 | A1 * | 8/2020 | E21B 33/062 |
| WO | 2022173914 | A1 | 8/2022 | |

OTHER PUBLICATIONS

CN 116220605.*
CN 207111033.*
Beim et al, "Improving Performance—Electrification of Well Control Equipment", IADC/SPE-212506-MS, SPE/IADC International Drilling Conference and Exhibition, Mar. 2023, 10 pages.
Givens et al., "Pressure On-Demand—Hybrid Electric BOP Control Systems", IADC/SPE-212555-MS, SPE/IADC International Drilling Conference and Exhibition, Mar. 2023, 8 pages.
Search Report and Written Opinion of International Patent Application No. PCT/US2024/023665 dated Jul. 18, 2024, 12 pages.
Search Report and Written Opinion of International Patent Application No. PCT/US2024/029598 dated Sep. 6, 2024, 11 pages.

* cited by examiner

ELECTRICALLY-ACTUATED BLOW-OUT PREVENTER

BACKGROUND

A blow-out preventer (BOP) is large valve at the top of a well that may be closed if the drilling crew loses control of formation fluids. By closing this valve, the drilling crew usually regains control of the reservoir, and procedures can then be initiated to increase the mud density until it is possible to open the BOP and retain pressure control of the formation. Conventional BOPs are closed hydraulically. However, it is difficult to control the speed and/or torque of a hydraulically-actuated BOP.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A method is disclosed. The method includes actuating a blow-out preventer (BOP) by moving a ram using an electric motor. The method also includes capturing sensor data with one or more sensors as the BOP is electrically-actuated. The method also includes determining one or more parameters with a controller based upon the sensor data. The method also includes controlling the electric motor based upon the one or more parameters.

A method for operating a blow-out preventer (BOP) is also disclosed. The method includes electrically-actuating the BOP in response to a pressure in a well exceeding a predetermined pressure threshold. Electrically-actuating the BOP includes moving two rams toward or away from one another using two electric motors. The two electric motors each include a variable-frequency drive (VFD). The method also includes capturing sensor data with a plurality of sensors as the BOP is electrically-actuated. The sensor data includes position data, speed data, and torque data. The method also includes determining a plurality of parameters with a controller based upon the sensor data. A first of the parameters includes positions of the two rams based upon the position data. A second of the parameters includes speeds of the two rams based upon the speed data. A third of the parameters includes torques of the two electric motors based upon the torque data. The method also includes controlling the two electric motors based upon the parameters. Controlling the two electric motors includes controlling a frequency and/or a voltage of a power supplied to the VFDs of the two electric motors. Controlling the frequency and/or the voltage causes the two electric motors to operate in a first mode as the two rams move toward a pipe therebetween and in a second mode as the two rams cut through the pipe. The speeds of the two electric motors are greater than a predetermined speed threshold in the first mode and less than the predetermined speed threshold in the second mode. The torques of the two electric motors are less than a predetermined torque threshold in the first mode and greater than the predetermined torque threshold in the second mode.

A system is also disclosed. The system includes an electric motor configured to actuate a blow-out preventer (BOP) by moving a ram. The system also includes one or more sensors configured to capture sensor data as the BOP is actuated. The system also includes a controller configured to determine one or more parameters based upon the sensor data. The controller is also configured to control the electric motor based upon the one or more parameters.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to specific embodiments illustrated in the accompanying drawings and figures. In the following detailed description, numerous specific details are set forth in order to provide a thorough understanding of the invention. However, it will be apparent to one of ordinary skill in the art that embodiments may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first object could be termed a second object or step, and, similarly, a second object could be termed a first object or step, without departing from the scope of the present disclosure.

The terminology used in the description of the invention herein is for the purpose of describing particular embodiments only and is not intended to be limiting. As used in the description of the invention and the appended claims, the singular forms "a," "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Further, as used herein, the term "if" may be construed to mean "when" or "upon" or "in response to determining" or "in response to detecting," depending on the context.

Figure 1:
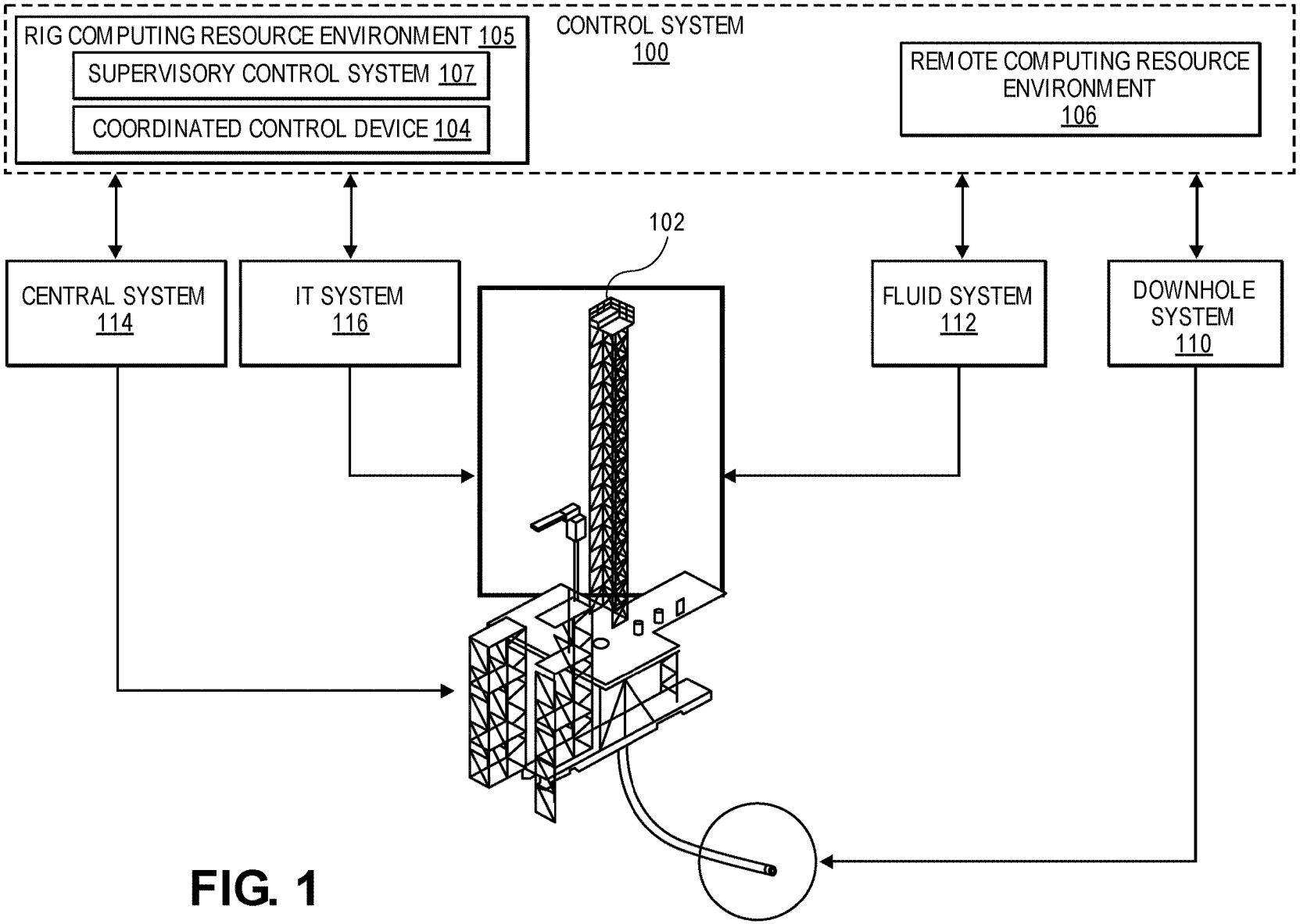
FIG. 1 illustrates a conceptual, schematic view of a control system for a drilling rig, according to an embodiment.

FIG. 1 illustrates a conceptual, schematic view of a control system 100 for a drilling rig 102, according to an embodiment. The control system 100 may include a rig computing resource environment 105, which may be located onsite at the drilling rig 102 and, in some embodiments, may have a coordinated control device 104. The control system 100 may also provide a supervisory control system 107. In some embodiments, the control system 100 may include a remote computing resource environment 106, which may be located offsite from the drilling rig 102.

The remote computing resource environment 106 may include computing resources locating offsite from the drilling rig 102 and accessible over a network. A "cloud" computing environment is one example of a remote computing resource. The cloud computing environment may communicate with the rig computing resource environment 105 via a network connection (e.g., a WAN or LAN connection). In some embodiments, the remote computing resource environment 106 may be at least partially located onsite, e.g., allowing control of various aspects of the drilling rig 102 onsite through the remote computing resource environment 105 (e.g., via mobile devices). Accordingly, "remote" should not be limited to any particular distance away from the drilling rig 102.

Further, the drilling rig 102 may include various systems with different sensors and equipment for performing operations of the drilling rig 102, and may be monitored and controlled via the control system 100, e.g., the rig computing resource environment 105. Additionally, the rig computing resource environment 105 may provide for secured access to rig data to facilitate onsite and offsite user devices monitoring the rig, sending control processes to the rig, and the like.

Various example systems of the drilling rig 102 are depicted in FIG. 1. For example, the drilling rig 102 may include a downhole system 110, a fluid system 112, and a central system 114. These systems 110, 112, 114 may also be examples of "subsystems" of the drilling rig 102, as described herein. In some embodiments, the drilling rig 102 may include an information technology (IT) system 116. The downhole system 110 may include, for example, a bottom-hole assembly (BHA), mud motors, sensors, etc. disposed along the drill string, and/or other drilling equipment configured to be deployed into the wellbore. Accordingly, the downhole system 110 may refer to tools disposed in the wellbore, e.g., as part of the drill string used to drill the well.

The fluid system 112 may include, for example, drilling mud, pumps, valves, cement, mud-loading equipment, mud-management equipment, pressure-management equipment, separators, and other fluids equipment. Accordingly, the fluid system 112 may perform fluid operations of the drilling rig 102.

The central system 114 may include a hoisting and rotating platform, top drives, rotary tables, kellys, drawworks, pumps, generators, tubular handling equipment, derricks, masts, substructures, and other suitable equipment. Accordingly, the central system 114 may perform power generation, hoisting, and rotating operations of the drilling rig 102, and serve as a support platform for drilling equipment and staging ground for rig operation, such as connection make up, etc. The IT system 116 may include software, computers, and other IT equipment for implementing IT operations of the drilling rig 102.

The control system 100, e.g., via the coordinated control device 104 of the rig computing resource environment 105, may monitor sensors from multiple systems of the drilling rig 102 and provide control commands to multiple systems of the drilling rig 102, such that sensor data from multiple systems may be used to provide control commands to the different systems of the drilling rig 102. For example, the system 100 may collect temporally and depth aligned surface data and downhole data from the drilling rig 102 and store the collected data for access onsite at the drilling rig 102 or offsite via the rig computing resource environment 105. Thus, the system 100 may provide monitoring capability. Additionally, the control system 100 may include supervisory control via the supervisory control system 107.

In some embodiments, one or more of the downhole system 110, fluid system 112, and/or central system 114 may be manufactured and/or operated by different vendors. In such an embodiment, certain systems may not be capable of unified control (e.g., due to different protocols, restrictions on control permissions, safety concerns for different control systems, etc.). An embodiment of the control system 100 that is unified, may, however, provide control over the drilling rig 102 and its related systems (e.g., the downhole system 110, fluid system 112, and/or central system 114, etc.). Further, the downhole system 110 may include one or a plurality of downhole systems. Likewise, fluid system 112, and central system 114 may contain one or a plurality of fluid systems and central systems, respectively.

In addition, the coordinated control device 104 may interact with the user device(s) (e.g., human-machine interface(s)) 118, 120. For example, the coordinated control device 104 may receive commands from the user devices 118, 120 and may execute the commands using two or more of the rig systems 110, 112, 114, e.g., such that the operation of the two or more rig systems 110, 112, 114 act in concert and/or off-design conditions in the rig systems 110, 112, 114 may be avoided.

Figure 2:
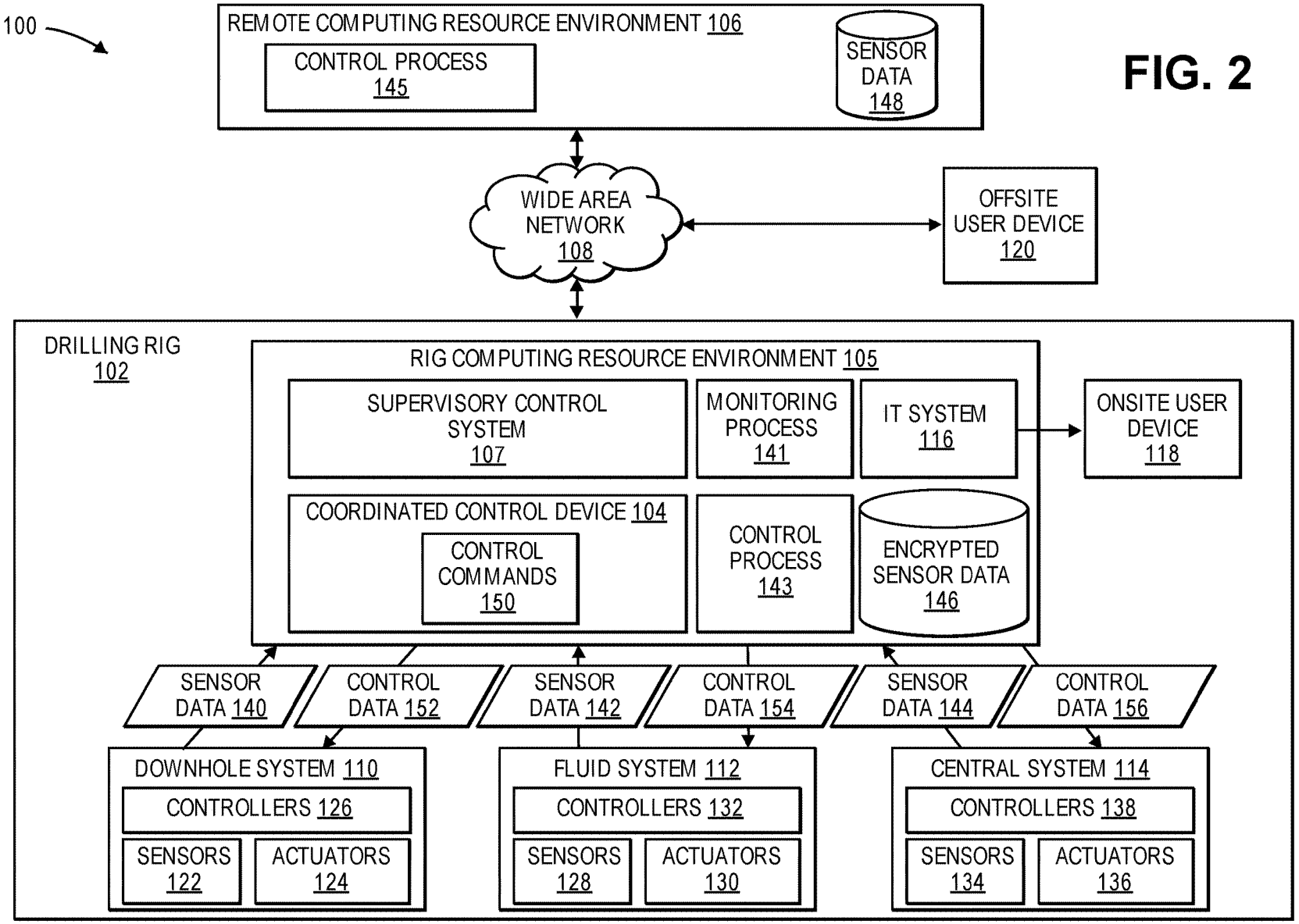
FIG. 2 illustrates a conceptual, schematic view of the control system, according to an embodiment.

FIG. 2 illustrates a conceptual, schematic view of the control system 100, according to an embodiment. The rig computing resource environment 105 may communicate with offsite devices and systems using a network 108 (e.g., a wide area network (WAN) such as the internet). Further, the rig computing resource environment 105 may communicate with the remote computing resource environment 106 via the network 108. FIG. 2 also depicts the aforementioned example systems of the drilling rig 102, such as the downhole system 110, the fluid system 112, the central system 114, and the IT system 116. In some embodiments, one or more onsite user devices 118 may also be included on the drilling rig 102. The onsite user devices 118 may interact with the IT system 116. The onsite user devices 118 may include any number of user devices, for example, stationary user devices intended to be stationed at the drilling rig 102 and/or portable user devices. In some embodiments, the onsite user devices 118 may include a desktop, a laptop, a smartphone, a personal data assistant (PDA), a tablet component, a wearable computer, or other suitable devices. In some embodiments, the onsite user devices 118 may communicate with the rig computing resource environment 105 of the drilling rig 102, the remote computing resource environment 106, or both.

One or more offsite user devices 120 may also be included in the system 100. The offsite user devices 120 may include a desktop, a laptop, a smartphone, a personal data assistant (PDA), a tablet component, a wearable computer, or other suitable devices. The offsite user devices 120 may be configured to receive and/or transmit information (e.g., monitoring functionality) from and/or to the drilling rig 102 via communication with the rig computing resource environment 105. In some embodiments, the offsite user devices 120 may provide control processes for controlling operation of the various systems of the drilling rig 102. In some embodiments, the offsite user devices 120 may communicate with the remote computing resource environment 106 via the network 108.

The user devices 118 and/or 120 may be examples of a human-machine interface. These devices 118, 120 may allow feedback from the various rig subsystems to be displayed and allow commands to be entered by the user. In various embodiments, such human-machine interfaces may be onsite or offsite, or both.

The systems of the drilling rig 102 may include various sensors, actuators, and controllers (e.g., programmable logic controllers (PLCs)), which may provide feedback for use in the rig computing resource environment 105. For example, the downhole system 110 may include sensors 122, actuators 124, and controllers 126. The fluid system 112 may include sensors 128, actuators 130, and controllers 132. Additionally, the central system 114 may include sensors 134, actuators 136, and controllers 138. The sensors 122, 128, and 134 may include any suitable sensors for operation of the drilling rig 102. In some embodiments, the sensors 122, 128, and 134 may include a camera, a pressure sensor, a temperature sensor, a flow rate sensor, a vibration sensor, a current sensor, a voltage sensor, a resistance sensor, a gesture detection sensor or device, a voice actuated or recognition device or sensor, or other suitable sensors.

The sensors described above may provide sensor data feedback to the rig computing resource environment 105 (e.g., to the coordinated control device 104). For example, downhole system sensors 122 may provide sensor data 140, the fluid system sensors 128 may provide sensor data 142, and the central system sensors 134 may provide sensor data 144. The sensor data 140, 142, and 144 may include, for example, equipment operation status (e.g., on or off, up or down, set or release, etc.), drilling parameters (e.g., depth, hook load, torque, etc.), auxiliary parameters (e.g., vibration data of a pump) and other suitable data. In some embodiments, the acquired sensor data may include or be associated with a timestamp (e.g., a date, time or both) indicating when the sensor data was acquired. Further, the sensor data may be aligned with a depth or other drilling parameter.

Acquiring the sensor data into the coordinated control device 104 may facilitate measurement of the same physical properties at different locations of the drilling rig 102. In some embodiments, measurement of the same physical properties may be used for measurement redundancy to enable continued operation of the well. In yet another embodiment, measurements of the same physical properties at different locations may be used for detecting equipment conditions among different physical locations. In yet another embodiment, measurements of the same physical properties using different sensors may provide information about the relative quality of each measurement, resulting in a "higher" quality measurement being used for rig control, and process applications. The variation in measurements at different locations over time may be used to determine equipment performance, system performance, scheduled maintenance due dates, and the like. Furthermore, aggregating sensor data from each subsystem into a centralized environment may enhance drilling process and efficiency. For example, slip status (e.g., in or out) may be acquired from the sensors and provided to the rig computing resource environment 105, which may be used to define a rig state for automated control. In another example, acquisition of fluid samples may be measured by a sensor and related with bit depth and time measured by other sensors. Acquisition of data from a camera sensor may facilitate detection of arrival and/or installation of materials or equipment in the drilling rig 102. The time of arrival and/or installation of materials or equipment may be used to evaluate degradation of a material, scheduled maintenance of equipment, and other evaluations.

The coordinated control device 104 may facilitate control of individual systems (e.g., the central system 114, the downhole system, or fluid system 112, etc.) at the level of each individual system. For example, in the fluid system 112, sensor data 128 may be fed into the controller 132, which may respond to control the actuators 130. However, for control operations that involve multiple systems, the control may be coordinated through the coordinated control device 104. Examples of such coordinated control operations include the control of downhole pressure during tripping. The downhole pressure may be affected by both the fluid system 112 (e.g., pump rate and choke position) and the central system 114 (e.g., tripping speed). When it is desired to maintain certain downhole pressure during tripping, the coordinated control device 104 may be used to direct the appropriate control commands. Furthermore, for mode based controllers which employ complex computation to reach a control setpoint, which are typically not implemented in the subsystem PLC controllers due to complexity and high computing power demands, the coordinated control device 104 may provide the adequate computing environment for implementing these controllers.

In some embodiments, control of the various systems of the drilling rig 102 may be provided via a multi-tier (e.g., three-tier) control system that includes a first tier of the controllers 126, 132, and 138, a second tier of the coordinated control device 104, and a third tier of the supervisory control system 107. The first tier of the controllers may be responsible for safety critical control operation, or fast loop feedback control. The second tier of the controllers may be responsible for coordinated controls of multiple equipment or subsystems, and/or responsible for complex model based controllers. The third tier of the controllers may be responsible for high level task planning, such as to command the rig system to maintain certain bottom hole pressure. In other embodiments, coordinated control may be provided by one or more controllers of one or more of the drilling rig systems 110, 112, and 114 without the use of a coordinated control device 104. In such embodiments, the rig computing resource environment 105 may provide control processes directly to these controllers for coordinated control. For example, in some embodiments, the controllers 126 and the controllers 132 may be used for coordinated control of multiple systems of the drilling rig 102.

The sensor data 140, 142, and 144 may be received by the coordinated control device 104 and used for control of the drilling rig 102 and the drilling rig systems 110, 112, and 114. In some embodiments, the sensor data 140, 142, and 144 may be encrypted to produce encrypted sensor data 146. For example, in some embodiments, the rig computing resource environment 105 may encrypt sensor data from different types of sensors and systems to produce a set of encrypted sensor data 146. Thus, the encrypted sensor data 146 may not be viewable by unauthorized user devices (either offsite or onsite user device) if such devices gain access to one or more networks of the drilling rig 102. The sensor data 140, 142, 144 may include a timestamp and an aligned drilling parameter (e.g., depth) as discussed above. The encrypted sensor data 146 may be sent to the remote computing resource environment 106 via the network 108 and stored as encrypted sensor data 148.

The rig computing resource environment 105 may provide the encrypted sensor data 148 available for viewing and processing offsite, such as via offsite user devices 120. Access to the encrypted sensor data 148 may be restricted via access control implemented in the rig computing resource environment 105. In some embodiments, the encrypted sensor data 148 may be provided in real-time to offsite user devices 120 such that offsite personnel may view real-time status of the drilling rig 102 and provide feedback based on the real-time sensor data. For example, different portions of the encrypted sensor data 146 may be sent to offsite user devices 120. In some embodiments, encrypted sensor data may be decrypted by the rig computing resource environment 105 before transmission or decrypted on an offsite user device after encrypted sensor data is received.

The offsite user device 120 may include a client (e.g., a thin client) configured to display data received from the rig computing resource environment 105 and/or the remote computing resource environment 106. For example, multiple types of thin clients (e.g., devices with display capability and minimal processing capability) may be used for certain functions or for viewing various sensor data.

The rig computing resource environment 105 may include various computing resources used for monitoring and controlling operations such as one or more computers having a processor and a memory. For example, the coordinated control device 104 may include a computer having a processor and memory for processing sensor data, storing sensor data, and issuing control commands responsive to sensor data. As noted above, the coordinated control device 104 may control various operations of the various systems of the drilling rig 102 via analysis of sensor data from one or more drilling rig systems (e.g. 110, 112, 114) to enable coordinated control between each system of the drilling rig 102. The coordinated control device 104 may execute control commands 150 for control of the various systems of the drilling rig 102 (e.g., drilling rig systems 110, 112, 114). The coordinated control device 104 may send control data determined by the execution of the control commands 150 to one or more systems of the drilling rig 102. For example, control data 152 may be sent to the downhole system 110, control data 154 may be sent to the fluid system 112, and control data 154 may be sent to the central system 114. The control data may include, for example, operator commands (e.g., turn on or off a pump, switch on or off a valve, update a physical property setpoint, etc.). In some embodiments, the coordinated control device 104 may include a fast control loop that directly obtains sensor data 140, 142, and 144 and executes, for example, a control algorithm. In some embodiments, the coordinated control device 104 may include a slow control loop that obtains data via the rig computing resource environment 105 to generate control commands.

In some embodiments, the coordinated control device 104 may intermediate between the supervisory control system 107 and the controllers 126, 132, and 138 of the systems 110, 112, and 114. For example, in such embodiments, a supervisory control system 107 may be used to control systems of the drilling rig 102. The supervisory control system 107 may include, for example, devices for entering control commands to perform operations of systems of the drilling rig 102. In some embodiments, the coordinated control device 104 may receive commands from the supervisory control system 107, process the commands according to a rule (e.g., an algorithm based upon the laws of physics for drilling operations), and/or control processes received from the rig computing resource environment 105, and provides control data to one or more systems of the drilling rig 102. In some embodiments, the supervisory control system 107 may be provided by and/or controlled by a third party. In such embodiments, the coordinated control device 104 may coordinate control between discrete supervisory control systems and the systems 110, 112, and 114 while using control commands that may be optimized from the sensor data received from the systems 110 112, and 114 and analyzed via the rig computing resource environment 105.

The rig computing resource environment 105 may include a monitoring process 141 that may use sensor data to determine information about the drilling rig 102. For example, in some embodiments the monitoring process 141 may determine a drilling state, equipment health, system health, a maintenance schedule, or any combination thereof. Furthermore, the monitoring process 141 may monitor sensor data and determine the quality of one or a plurality of sensor data. In some embodiments, the rig computing resource environment 105 may include control processes 143 that may use the sensor data 146 to optimize drilling operations, such as, for example, the control of drilling equipment to improve drilling efficiency, equipment reliability, and the like. For example, in some embodiments the acquired sensor data may be used to derive a noise cancellation scheme to improve electromagnetic and mud pulse telemetry signal processing. The control processes 143 may be implemented via, for example, a control algorithm, a computer program, firmware, or other suitable hardware and/or software. In some embodiments, the remote computing resource environment 106 may include a control process 145 that may be provided to the rig computing resource environment 105.

The rig computing resource environment 105 may include various computing resources, such as, for example, a single computer or multiple computers. In some embodiments, the rig computing resource environment 105 may include a virtual computer system and a virtual database or other virtual structure for collected data. The virtual computer system and virtual database may include one or more resource interfaces (e.g., web interfaces) that enable the submission of application programming interface (API) calls to the various resources through a request. In addition, each of the resources may include one or more resource interfaces that enable the resources to access each other (e.g., to enable a virtual computer system of the computing resource environment to store data in or retrieve data from the database or other structure for collected data).

The virtual computer system may include a collection of computing resources configured to instantiate virtual machine instances. The virtual computing system and/or computers may provide a human-machine interface through which a user may interface with the virtual computer system via the offsite user device or, in some embodiments, the onsite user device. In some embodiments, other computer systems or computer system services may be utilized in the rig computing resource environment 105, such as a computer system or computer system service that provisions computing resources on dedicated or shared computers/servers and/or other physical devices. In some embodiments, the rig computing resource environment 105 may include a single server (in a discrete hardware component or as a virtual server) or multiple servers (e.g., web servers, application servers, or other servers). The servers may be, for example, computers arranged in any physical and/or virtual configuration In some embodiments, the rig computing resource environment 105 may include a database that may be a collection of computing resources that run one or more data collections. Such data collections may be operated and managed by utilizing API calls. The data collections, such as sensor data, may be made available to other resources in the rig computing resource environment or to user devices (e.g., onsite user device 118 and/or offsite user device 120) accessing the rig computing resource environment 105. In some embodiments, the remote computing resource environment 106 may include similar computing resources to those described above, such as a single computer or multiple computers (in discrete hardware components or virtual computer systems).

Electrically-Actuated Blow-Out Preventer (BOP)

Figure 3:
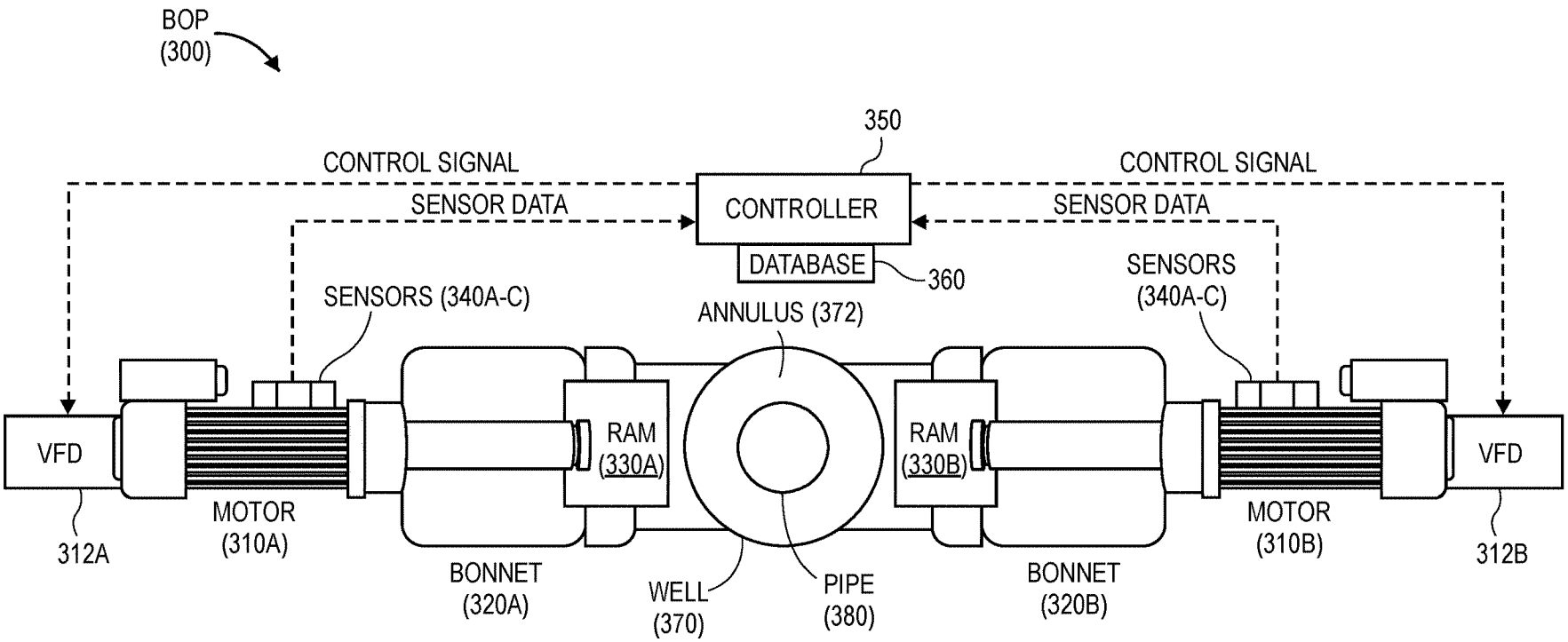
FIG. 3 illustrates a schematic plan view of a BOP with shear rams in a first (e.g., open) position where the shear rams are positioned away from a pipe, according to an embodiment.

FIG. 3 illustrates a schematic plan view of a BOP 300, according to an embodiment. The BOP 300 may include one or more motors (two are shown: 310A, 310B). The motors 310A, 310B may be positioned on opposite sides of a well 370 and/or pipe 380. The motors 310A, 310B may be or include electric motors. More particularly, the motors 310A, 310B may each include or be coupled to a variable frequency drive (VFD) (two are shown: 312A, 312B). The VFDs 312A, 312B are alternating current (AC) motor drives that control the speed and/or torque of the motors 310A. 310B by varying the frequency of the input electricity to the motors 310A, 310B.

The BOP 300 may also include one or more bonnets (two are shown: 320A, 320B). The bonnets 320A, 320B may be coupled to the motors 310A, 310B and be positioned at least partially between the motors 310A, 310B and the well 370 and/or pipe 380.

The BOP 300 may also include one or more rams (two are shown: 330A, 330B). The rams 330A, 330B are shown in a first (e.g., open) position in FIG. 3 where the rams 330A, 330B are positioned away (e.g., spaced apart) from the pipe 380. Inner portions (e.g., rotors) of the motors 310A, 310B may rotate, and that rotation may be converted into linear movement of the rams 330A, 330B (e.g., toward or away from the pipe 380).

Figure 4:
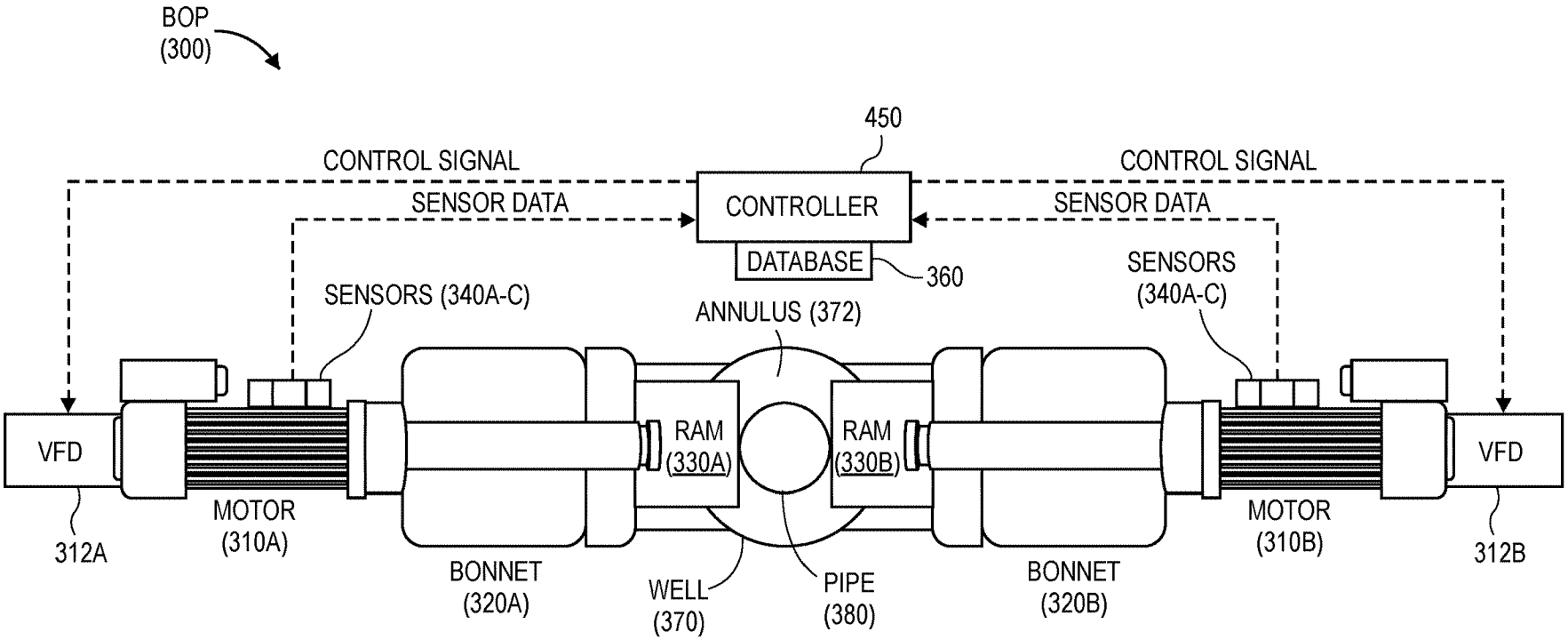
FIG. 4 illustrates a schematic plan view of the BOP with the shear rams in a second (e.g., intermediate) position where the shear rams are making initial contact with the pipe, according to an embodiment.
Figure 5:
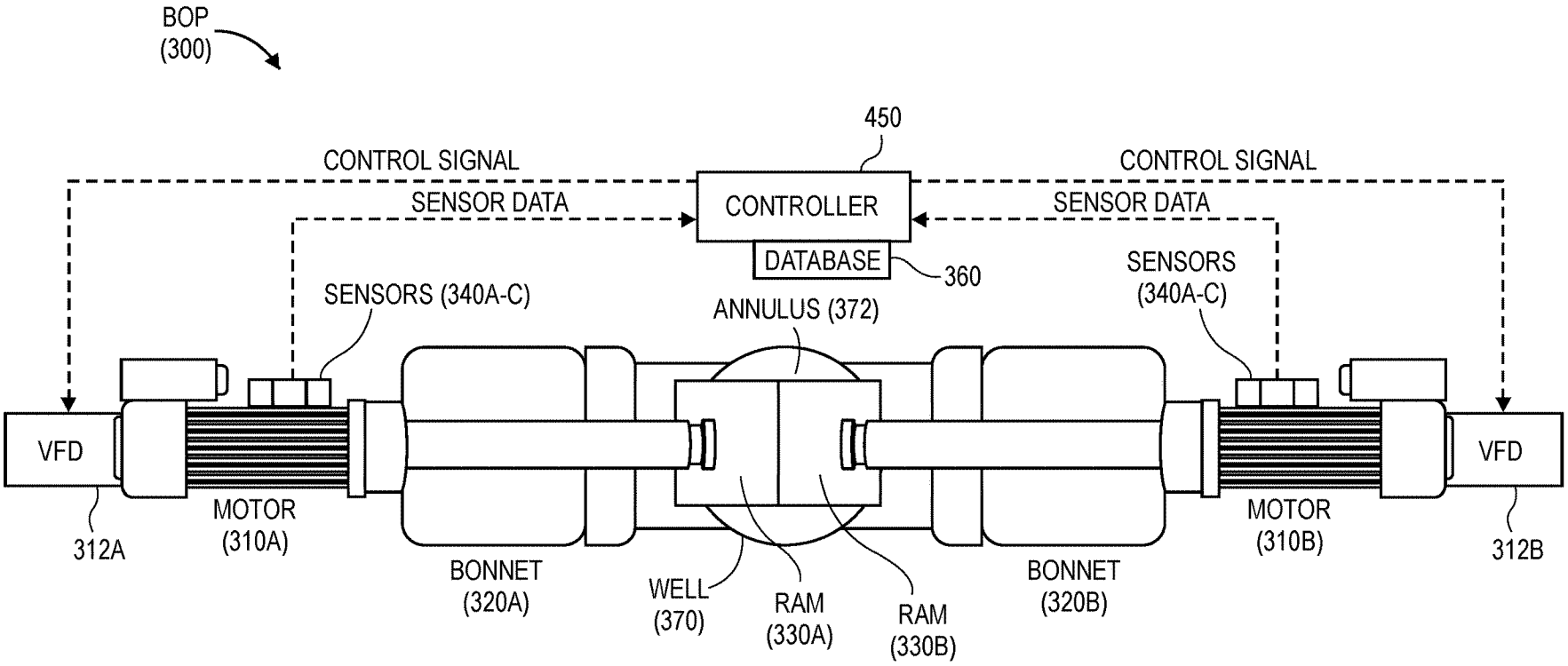
FIG. 5 illustrates a schematic plan view of the BOP with the shear rams in a third (e.g., closed) position where the pipe has been sheared and sealed by the shear rams, according to an embodiment.

The rams 330A-330B shown in FIGS. 3-5 are shear rams. The shear rams 330A, 330B are closing elements of the BOP 300 that are fitted with blades that are designed to cut (i.e., shear) the pipe 380. Once the pipe 380 has been cut, the shear rams 330A, 330B may close (e.g., contact one another) to provide isolation or sealing of the well 370 and/or pipe 380.

The BOP 300 may also include one or more sensors (three are shown: 340A-340C). The sensors 340A-340C may be coupled to and/or in communication with the motors 310A, 310B, the bonnets 320A, 320B, the shear rams 330A, 330B, or a combination thereof.

The sensors 340A may be configured to measure position data. In one embodiment, the position data may be or include the position of the shear rams 330A, 330B. The position of the shear rams 330A, 330B may be an absolute position (e.g., in XYZ coordinates), or in relation to a position of the motors 310A, 310B and/or the pipe 380 (e.g., 3 cm away from the pipe 380). In another embodiment, the position data may include a number of rotations of the (e.g., rotors of the) motors 310A, 310B, and the positions of the shear rams 330A, 330B may be determined based upon the number of rotations.

The sensors 340B may be configured to measure speed data. In one embodiment, the speed data may be or include the speed of the shear rams 330A, 330B. This may be or include the (e.g., linear) speed at which the shear rams 330A, 330B are moving toward/into a closed position (e.g., 2 cm/second toward the pipe 380). In another embodiment, the speed data may be or include rates of rotations of the (e.g., rotors of the) motors 310A, 310B, and the speeds of the shear rams 330A, 330B may be determined based upon the rates of rotations.

The sensors 340C may be configured to measure torque data. This may include the torques of the motors 310A, 310B. In one embodiment, the torque may be measured directly. In another embodiment, the torque data may be or include the power (e.g., electrical current) used by the motors 310A, 310B, and the torque may be determined based upon the power.

The BOP 300 may also include one or more controllers (one is shown: 350). The controller 350 may be coupled to and/or in communication with the motors 310A, 310B (e.g., the VFDs 312A, 312B) and/or the sensors 340A-340C. The controller 350 may be configured to determine the position(s) of the shear rams 330A, 330B based upon the position data measured by the sensors 340A. The controller 350 may also be configured to determine the speed of the shear rams 330A, 330B based upon the speed data measured by the sensors 340B. The controller 350 may also be configured to determine the torque of the motors 310A, 310B based upon the torque data measured by the sensors 340C.

Then, the controller 350 may be configured to control the motors 310A, 310B (e.g., the VFDs 312A, 312B) based at least partially upon the position(s) of the shear rams 330A, 330B, the speed(s) of the shear ram(s) 330A, 330B, the torque(s) of the motors 310A, 310B, or a combination thereof. In one example, the controller 350 may control (e.g., modify) the power (e.g., voltage and/or current) provided to the motors 310A, 310B. In another example, the controller 350 may control (e.g., modify) the frequency provided to the motors 310A, 310B (e.g., the VFDs 312A, 312B). Controlling the amount of power and/or frequency may, in turn, control (e.g., modify) the position(s), the speed(s), the torque(s), or a combination thereof.

The BOP 300 may be electrically-actuated, which is in contrast to conventional BOPs that are hydraulically-actuated. The electrical actuation may allow the sensors 340A-340C to measure precise position data, speed data, and torque data. The electrical actuation may also allow the controller 350 to precisely control the position, speed, and torque at different intervals during the electrical actuation, as described below. Conventional hydraulic BOPs cannot be precisely controlled in this manner. The BOP 300 may not include any hydraulic components.

The BOP 300 may also include a database 360. The database 360 may be coupled to and/or in communication with the sensors 340A-340C and/or the controller 350. The database 360 may include previously-captured position data, speed data, and torque data, as well as the size(s) of the pipe(s) 380 that may be used. In addition to controlling (e.g., modifying) the position(s), the speed(s), and/or the torque(s) based upon the position data, speed data, and/or torque data, the controller 350 may also or instead control the position(s), the speed(s), and/or the torque(s) based at least partially upon the data in the database 360. This may help to calibrate and/or optimize the operation of the BOP 300.

FIG. 4 illustrates a schematic plan view of the BOP 300 with the shear rams 330A. 330B in a second (e.g., intermediate) position, according to an embodiment. The BOP 300 may be electrically-actuated to cause the shear rams 330A, 330B to move from the open position (FIG. 3) to the intermediate position (FIG. 4). The shear rams 330A, 330B are in contact with the pipe 380 but have not (yet) cut through the pipe 380 when in the intermediate position.

The controller 350 may determine that the distance between the shear rams 330A, 330B and the pipe 380 is 0 cm based upon the position data when the shear rams 330A, 330B are in the intermediate position. The controller 350 may also or instead determine that the speed of the shear rams 330A, 330B has decreased based upon the speed data when the shear rams 330A, 330B are in the intermediate position (e.g., due to the contact with the pipe 380). The controller 350 may also or instead determine that the torque has suddenly increased based upon the torque data when the shear rams 330A, 330B are in the intermediate position. More particularly, the motors 310A. 310B may have a first (e.g., lower) torque when actuating from the open position to the intermediate position (e.g., due to the shear rams 330A, 330B being unimpeded), and the torque may suddenly increase to a second (e.g., higher) torque when the shear rams 330A, 330B contact and/or cut through the pipe 380.

In one embodiment, the controller 350 may cause the motors 310A, 310B to operate in a first (e.g., speed) mode when the shear rams 330A, 330B are actuating from the open position to the intermediate position (e.g., toward the pipe 380 but not in contact with the pipe 380). The motors 310A, 310B, when operating in the speed mode, may have a first (e.g., faster) speed and/or a first (e.g., lower) torque. In an example, the speed may be from about 2000 rotations per minute (RPM) to about 3000 RPM or from about 2500 RPM to about 4000 RPM, and the torque may be from about 10 newton-meters (Nm) to about 50 Nm or from about 15 Nm to about 30 Nm when operating in the speed mode. In contrast, the speed and torque may not be controlled in conventional hydraulic BOPs. In addition, the electrical current provided to the motors 310A, 310B may be from about 5 amps (A) to about 25 A or from about 5 A to about 15 A, and the voltage provided to the motors 310A, 310B may be from about 150 volts (V) to about 200 V or from about 200 V to about 250 V when operating in the speed mode.

FIG. 5 illustrates a schematic plan view of the BOP 300 with the shear rams 330A, 330B in a third (e.g., closed) position, according to an embodiment. The BOP 300 may be electrically-actuated to cause the shear rams 330A, 330B to move from the intermediate position (FIG. 4) to the closed position (FIG. 5). The shear rams 330A, 330B have cut through the pipe 380 and/or are in contact with one another when in the closed position.

The controller 350 may determine that the distance between the shear rams 330A, 330B is 0 cm based upon the position data when the shear rams 330A, 330B are in the closed position. The controller 350 may also or instead determine that the speed of the shear rams 330A, 330B has changed (e.g., decreased to 0 cm/second) based upon the speed data when the shear rams 330A, 330B are in the closed position. The controller 350 may also or instead determine that the torque has suddenly changed based upon the torque data when the shear rams 330A, 330B are in the intermediate position. More particularly, the motors 310A, 310B may have the second (e.g., higher) torque when actuating from the intermediate position to the closed position (e.g., due to the shear rams 330A, 330B cutting the pipe 380), and the torque may suddenly change once the pipe 380 has been fully cut and/or the shear rams 330A, 330B are in contact with one another.

In one embodiment, the controller 350 may cause the motors 310A, 310B to operate in a second (e.g., torque) mode when the shear rams 330A, 330B are actuating from the intermediate position to the closed position (e.g., cutting the pipe 380). The motors 310A, 310B, when operating in the torque mode, may have a second (e.g., slower) speed and/or a second (e.g., higher) torque. In an example, the speed may be from about 500 rotations per minute (RPM) to about 1500 RPM or from about 1000 RPM to about 2500 RPM, and the torque may be from about 50 newton-meters (Nm) to about 200 Nm or from about 80 Nm to about 140 Nm when operating in the torque mode. As mentioned above, the speed and torque may not be controlled in conventional hydraulic BOPs. In addition, the electrical current provided to the motors 310A, 310B may be from about 15 amps (A) to about 75 A or from about 25 A to about 65 A, and the voltage provided to the motors 310A, 310B may be from about 200 volts (V) to about 250 V or from about 250 V to about 300 V when operating in the torque mode. In an example, the torque-limiting setpoint may be set to 45 Amps (approximately 112 Nm). When using speed mode, one variable being controlled is the frequency, and the resulting torque may vary based on the load and speed of the motors 310A, 310B. When the VFDs 312A, 312B are switched from speed mode to torque mode, the variable being controlled may be the voltage, and the resulting speed may vary.

Figure 6:
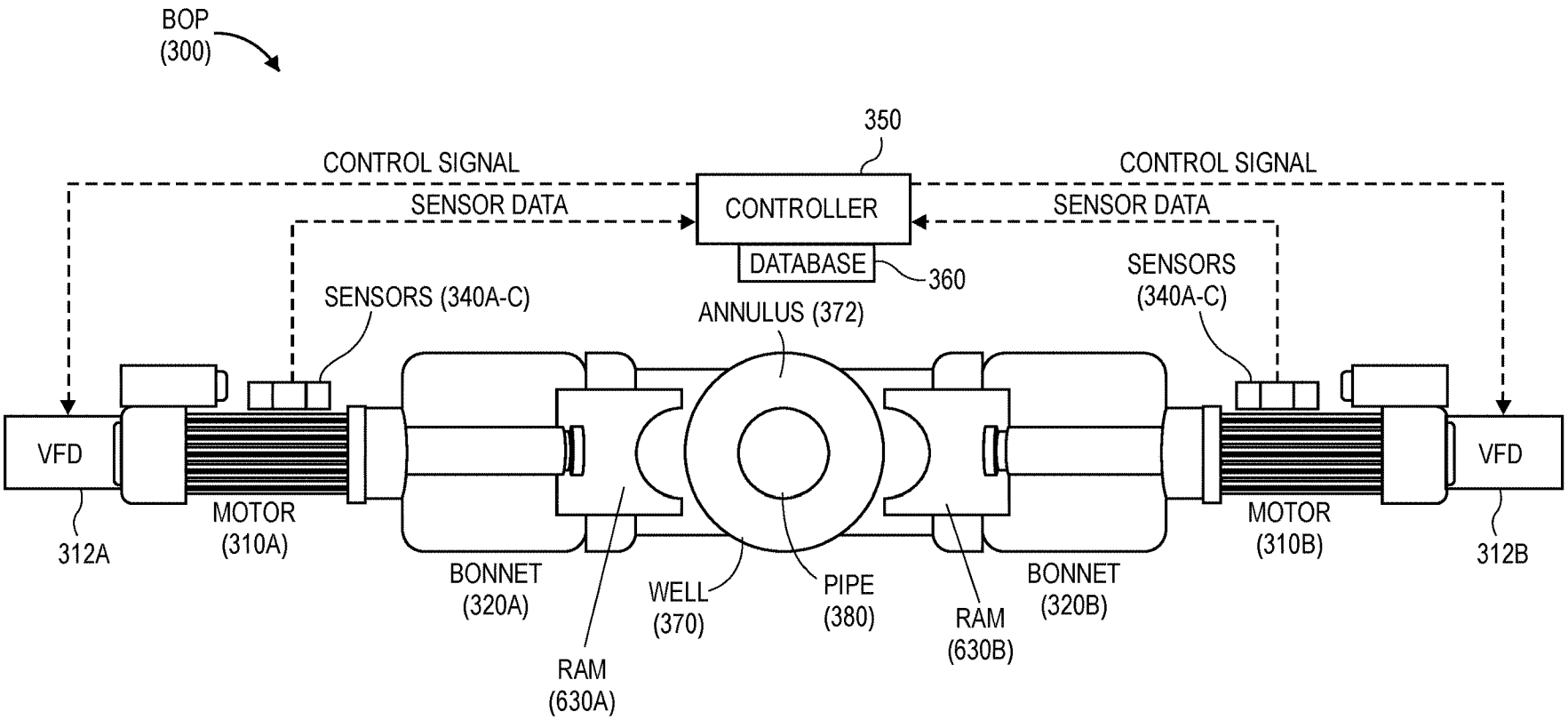
FIG. 6 illustrates a schematic plan view of the BOP with pipe rams in in a first (e.g., open) position where the pipe rams are positioned away from the pipe, according to an embodiment.

FIG. 6 illustrates a schematic plan view of the BOP 300 with pipe rams 630A, 630B in in a first (e.g., open) position, according to an embodiment. The pipe rams 630A, 630B may be used instead of the shear rams 330A, 330B. Rather than cutting the pipe 380, the pipe rams 630A, 630B may instead have curved inner surfaces that are configured to contact and seal around the pipe 380, as described below. The pipe rams 630A, 630B are shown in a first (e.g., open) position in FIG. 6 where the pipe rams 630A, 630B are positioned away (e.g., spaced apart) from the pipe 380.

Figure 7:
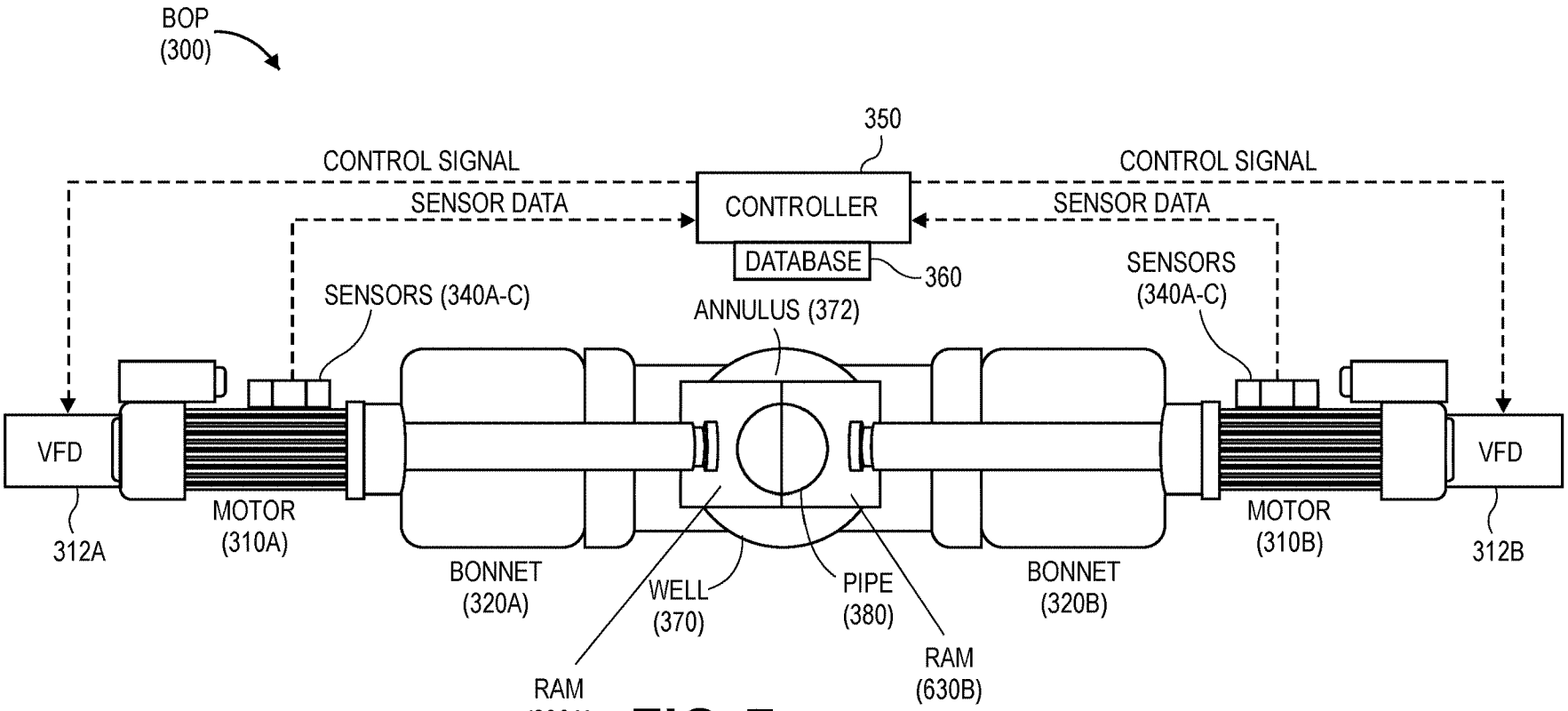
FIG. 7 illustrates a schematic plan view of the BOP with the pipe rams in a second (e.g., closed) position where the pipe rams are sealed around the pipe, according to an embodiment.

FIG. 7 illustrates a schematic plan view of the BOP 300 with the pipe rams 630A, 630B in a second (e.g., closed) position, according to an embodiment. The BOP 300 may be electrically-actuated to cause the pipe rams 630A, 630B to move from the open position (FIG. 6) to the closed position (FIG. 7). The pipe rams 630A, 630B are in contact with and sealing around the pipe 380 when in the closed position. This may isolate a first (e.g., upper) portion and a second (e.g., lower) portion of an annulus 372 in the wellbore 370.

The controller 350 may determine that the distance between the pipe rams 630A, 630B is equal to the size (e.g., diameter) of the pipe 380 based upon the position data when the pipe rams 630A, 630B are in the closed position. The controller 350 may also or instead determine that the speed of the pipe rams 630A, 630B has decreased (or stopped) based upon the speed data when the pipe rams 630A, 630B are in the closed position (e.g., due to the contact with the pipe 380). The controller 350 may also or instead determine that the torque has suddenly increased based upon the torque data when the pipe rams 630A, 630B are in the closed position. More particularly, the motors 310A, 310B may have a first (e.g., lower) torque when actuating from the open position to the closed position (e.g., due to the pipe rams 630A, 630B being unimpeded), and the torque may suddenly increase to a second (e.g., higher) torque when the pipe rams 630A, 630B contact the pipe 380.

In one embodiment, the controller 350 may cause the motors 310A, 310B to operate in the speed mode when the pipe rams 330A, 330B are actuating from the open position to the closed position (e.g., toward the pipe 380 but not yet in contact with the pipe 380). The motors 310A, 310B, when operating in the speed mode, may have a first (e.g., faster) speed and/or a first (e.g., lower) torque. In contrast, the speed and torque may not be controlled in conventional hydraulic BOPs.

Figure 8:
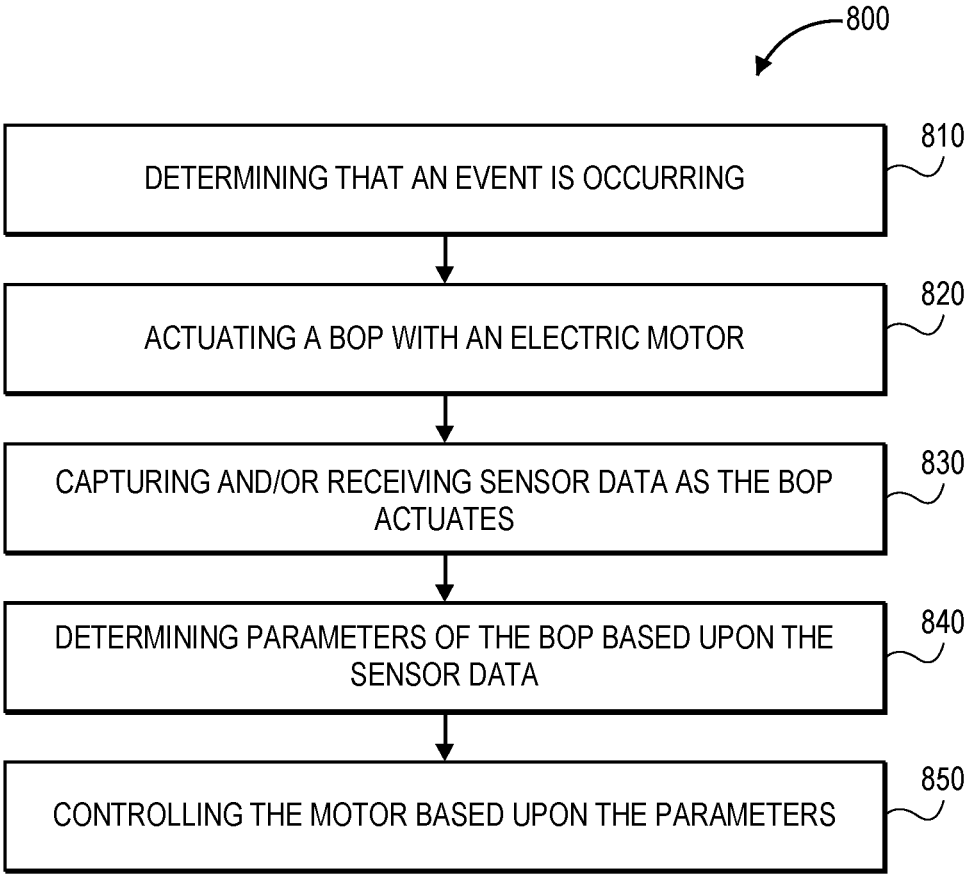
FIG. 8 illustrates a flowchart of a method for operating the BOP, according to an embodiment.

FIG. 8 illustrates a flowchart of a method 800 for operating the BOP 300, according to an embodiment. An illustrative order of the method 800 is provided below; however, one or more portions of the method 800 may be performed in a different order, simultaneously, repeated, or omitted.

The method 800 may include determining that an event is occurring, as at 810. The event may include the drilling crew losing control of formation fluids (e.g., in the wellbore 370). For example, it may be determined that the event is occurring when a pressure and/or flowrate in the wellbore 370, in the formation around the wellbore 370, and/or at the surface increases to above a predetermined pressure threshold.

The method 800 may also include actuating the BOP 300, as at 820. This may include electrically-actuating the rams 330A, 330B (or 630A, 630B) using the (e.g., electric) motors 310A, 310B. The rams 330A, 330B (or 630A, 630B) may be actuated from the open position to the intermediate position, from the open position to the closed position, or from the intermediate position to the closed position.

The method 800 may also include capturing and/or receiving sensor data, as at 830. The sensor data may be captured before, simultaneously with, or after the actuation of the BOP 300. The sensor data may be captured by the sensors 340A-340C and/or received by the controller 350 and/or the database 360. As mentioned above, the sensor data may be or include the position data, the speed data, the torque data, or a combination thereof.

The method 800 may also include determining one or more parameters of the BOP 300, as at 840. The parameter (s) may be determined by the controller 350. The parameter (s) may be determined based upon the sensor data. A first parameter may be or include the position of the rams 330A, 330B (or 630A, 630B). A second parameter may be or include the speed of the motors 310A, 310B and/or the rams 330A, 330B (or 630A, 630B). A third parameter may be or include the torque of the motors 310A, 310B.

The method 800 may also include controlling the motors 310A, 310B, as at 850. The motors 310A, 310B may be controlled by the controller 350 based at least partially upon the sensor data and/or the data in the database 360. As mentioned above, the controller 350 may control the motors 310A, 310B by controlling (e.g., modifying) the voltage, current, frequency, wavelength, pulse shape, etc. of the power supplied to the motors 310A, 310B (e.g., the VFDs).

In one example, the controller 350 may cause the rotors of the motors 310A, 310B to rotate in a first (e.g., clockwise) or second (e.g., counterclockwise) direction to modify the position of the rams 330A, 330B (or 630A, 630B) with respect to the pipe 380. In another example, the controller 350 may cause the rotors of the motors 310A, 310B to increase or decrease in speed to modify the linear speed of the rams 330A, 330B (or 630A, 630B). In another example, the controller 350 may increase or decrease the torque of the motors 310A. 310B. In another example, the controller 350 may cause the motors 310A, 310B to operate in (or switch into) the speed mode and/or the torque mode. In another example, the controller 350 may also cause the motors 310A, 310B to stop in response to the position and/or torque indicating that the rams 330A, 330B (or 630A, 630B) are in the closed position (see FIGS. 5 and 7).

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to explain at least some of the principals of the disclosure and their practical applications, to thereby enable others skilled in the art to utilize the disclosed methods and systems and various embodiments with various modifications as are suited to the particular use contemplated.

What is claimed is:

1. A method for operating a blow-out preventer (BOP), the method comprising:

electrically-actuating the BOP in response to a pressure in a well exceeding a predetermined pressure threshold, wherein electrically-actuating the BOP comprises moving two rams toward or away from one another using two electric motors, and wherein the two electric motors each comprise a variable-frequency drive (VFD);

capturing sensor data with a plurality of sensors as the BOP is electrically-actuated, wherein the sensor data comprises position data, speed data, and torque data;

determining a plurality of parameters with a controller based upon the sensor data, wherein a first of the parameters comprises positions of the two rams based upon the position data, wherein a second of the parameters comprises speeds of the two rams based upon the speed data, and wherein a third of the parameters comprises torques of the two electric motors based upon the torque data; and controlling the two electric motors based upon the parameters, wherein controlling the two electric motors comprises controlling a frequency and/or a voltage of a power supplied to the VFDs of the two electric motors, wherein controlling the frequency and/or the voltage causes the two electric motors to operate in a first mode as the two rams move toward a pipe therebetween and in a second mode as the two rams cut through the pipe, wherein the speeds of the two electric motors are greater than a predetermined speed threshold in the first mode and less than the predetermined speed threshold in the second mode, and wherein the torques of the two electric motors are less than a predetermined torque threshold in the first mode and greater than the predetermined torque threshold in the second mode.

2. The method of claim 1, wherein the predetermined speed threshold is between about 500 rotations per minute (RPM) and about 2500 RPM.

3. The method of claim 1, wherein the predetermined torque threshold is between about 20 newton-meters (Nm) and about 112 Nm.

4. The method of claim 1, wherein an electrical current of the power is from about 5 amps (A) to about 25 A when in the first mode, and from about 25 A to about 65 A when in the second mode.

5. The method of claim 1, wherein the voltage of the power is greater in the second mode than in the first mode.

* * * * *